US011844421B1

(12) United States Patent
Wang

(10) Patent No.: US 11,844,421 B1
(45) Date of Patent: Dec. 19, 2023

(54) COSMETIC TOOL

(71) Applicant: Shigang Wang, Shenzhen (CN)

(72) Inventor: Shigang Wang, Shenzhen (CN)

( * ) Notice: Subject to any disclaimer, the term of this patent is extended or adjusted under 35 U.S.C. 154(b) by 0 days.

(21) Appl. No.: 18/254,761

(22) PCT Filed: Aug. 26, 2022

(86) PCT No.: PCT/CN2022/115104

§ 371 (c)(1),
(2) Date: May 26, 2023

(87) PCT Pub. No.: WO2023/051122

PCT Pub. Date: Apr. 6, 2023

(30) Foreign Application Priority Data

Sep. 28, 2021 (CN) ..... 202111141297.X
Sep. 28, 2021 (CN) ..... 202122339389.0
(Continued)

(51) Int. Cl.
*A46B 15/00* (2006.01)
*A46B 11/00* (2006.01)
*A45D 33/34* (2006.01)

(52) U.S. Cl.
CPC ..... *A46B 15/00* (2013.01); *A45D 33/34* (2013.01); *A46B 11/0006* (2013.01); *A46B 2200/1046* (2013.01)

(58) Field of Classification Search
CPC ..... A46B 2200/1046; A46B 2200/20; A46B 11/00; A46B 11/0006; A46B 11/0062;
(Continued)

(56) References Cited

U.S. PATENT DOCUMENTS 5,382,107 A * 1/1995 Nian ..... A46B 5/0033 401/191
6,991,396 B2 * 1/2006 Gueret ..... B65D 47/42 132/320
(Continued)

FOREIGN PATENT DOCUMENTS

CN 1350823 5/2002
CN 2579240 10/2003
(Continued)

OTHER PUBLICATIONS

WIPO, International Search Report for PCT/CN2022/115104, dated Nov. 30, 2022.
(Continued)

*Primary Examiner* — Shay Karls
(74) *Attorney, Agent, or Firm* — Hodgson Russ LLP

(57) ABSTRACT

A cosmetic tool comprises a brush head, a material core, a movable sleeve, a fixed sleeve, and a transmission structure. The material core is mounted in the movable sleeve, the brush head is located at one end of the movable sleeve and is arranged opposite the material core, and a discharge port is formed in an end face of the material core facing the brush head. The fixed sleeve is sleeved outside the movable sleeve, and the movable sleeve can move along an axial direction. The fixed sleeve, the movable sleeve and the brush head are connected by means of a transmission structure, and when the movable sleeve moves along the axial direction, the movable sleeve drives the brush head) to turn over by means of the transmission structure, so as to dip in a cosmetic substance at the discharge port.

20 Claims, 14 Drawing Sheets

(30) Foreign Application Priority Data

| | | |
|---|---|---|
| Mar. 3, 2022 | (CN) | 202210200552.1 |
| Mar. 3, 2022 | (CN) | 202220442551.3 |
| Apr. 29, 2022 | (CN) | 202210454615.6 |
| Apr. 29, 2022 | (CN) | 202210458737.2 |
| Apr. 29, 2022 | (CN) | 202220986509.8 |
| Apr. 29, 2022 | (CN) | 202221003339.3 |

(58) Field of Classification Search
CPC ..... A46B 17/04; A45D 33/34; A45D 33/02; B41K 1/40; B41K 1/54; B41K 1/56
See application file for complete search history.

(56) References Cited

U.S. PATENT DOCUMENTS

| | | | | |
|---|---|---|---|---|
| 7,124,684 | B1 * | 10/2006 | Petersen | B41K 1/54 118/264 |
| 2002/0014246 | A1 | 2/2002 | Choi | |

FOREIGN PATENT DOCUMENTS

| | | |
|---|---|---|
| CN | 201770122 | 3/2011 |
| CN | 206342118 | 7/2017 |
| CN | 211048681 | 7/2020 |
| CN | 212698056 | 3/2021 |

OTHER PUBLICATIONS

WIPO, Written Opinion for International Application No. PCT/CN2022/115104, dated Nov. 30, 2022.

* cited by examiner

COSMETIC TOOL

CROSS-REFERENCE TO RELATED APPLICATIONS

This application is a U.S. National Stage entry of International Application No. PCT/CN2022/115104, filed Aug. 26, 2022, which claims priority to Chinese Patent Application Nos. 202111141297.X and 202122339389.0, each filed Sep. 28, 2021, Chinese Patent Application Nos. 202210200552.1 and 20220442551.3, each filed Mar. 3, 2022, Chinese Patent Application Nos. 202210454615.6, 202221003339.3, 202210458737.2, and 202220986509.8, each filed Apr. 29, 2022. The entire disclosures of the aforementioned applications are incorporated herein by reference.

TECHNICAL FIELD

The present disclosure relates to the technical field of cosmetics, and in particular to a cosmetic tool.

BACKGROUND

With the increasing improvement of living standards, the requirements for beauty are getting higher and higher, and cosmetics have well met this demand of consumers and developed rapidly. Meanwhile, it has also driven the rapid development of cosmetic tools. However, currently, a cosmetic tool usually includes a cosmetic rod and a brush head on the cosmetic rod. A user holds the cosmetic rod, dips the brush head in a cosmetic such as a powder cake, liquid foundation, blush and the like and then brush the cosmetic onto his/her face. Such a cosmetic tool has a simple structure, but the makeup operation is complicated, and at the same time, the cosmetic and the cosmetic tool need to be carried simultaneously, so that the portability is poor.

SUMMARY

There is provided a cosmetic tool according to embodiments of the present disclosure. The technical solution is as below:

According to one aspect of embodiments of the present disclosure, there is provide a cosmetic tool, which includes a brush head, a material core, a moving sleeve, a fixed sleeve and a transmission structure; wherein the material core is used for loading a cosmetic substance; the material core is mounted in the moving sleeve, the brush head is located at one end of the moving sleeve and disposed opposite to the material core, and an end face of the material core facing the brush head is provided with a discharge port; the fixed sleeve is sleeved outside the moving sleeve, and the moving sleeve is movable along an axial direction; and the fixed sleeve, the moving sleeve and the brush head are connected through the transmission structure;

wherein, when the moving sleeve moves along the axial direction, the moving sleeve drives the brush head to turn over through the transmission structure, so as to dip in a cosmetic substance at the discharge port.

BRIEF DESCRIPTION OF DRAWINGS

In order to describe the technical solutions in the embodiments of the present disclosure more clearly, the following briefly describes the accompanying drawings required for describing the embodiments or exemplary technology.

Apparently, the accompanying drawings in the following description are only some embodiments of the present disclosure, and those of ordinary skills in the art may still derive other drawings from these accompanying drawings without creative efforts.

DETAILED DESCRIPTION

Figure 1:
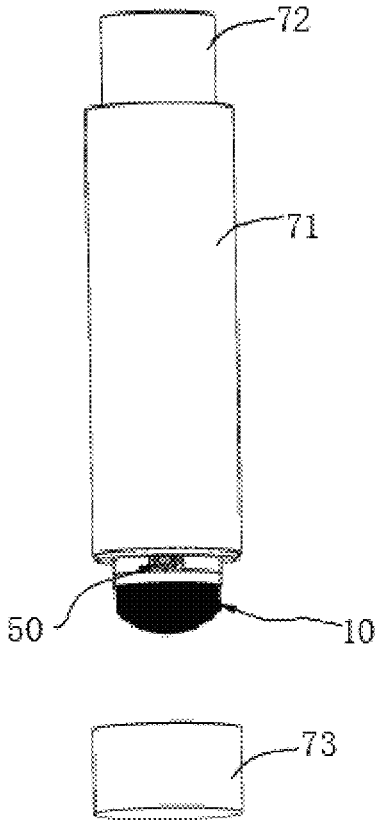
FIG. 1 is a schematic structural diagram of a cosmetic tool provided by an embodiment of the present disclosure.

Embodiments of the present disclosure will be described in detail hereinafter, examples of which are illustrated in the accompanying drawings, wherein the same or similar reference numerals indicate the same or similar elements or elements having the same or similar functions throughout. The embodiments described below with reference to the accompanying drawings are exemplary and are intended to explain the present disclosure, but not to be construed as limitations to the present disclosure.

In the description of the present disclosure, it should be understood that the orientation or positional relationships indicated by the terms "length", "width", "top", "bottom", "front", "back", "left", "right", "vertical", "horizontal", "top", "bottom", "inner", "outer" and the like are based on the orientation or positional relationships shown in the accompanying drawings, and are only for convenience of description of the present disclosure and simplification of the description, rather than indicating or implying that the indicated device or element must have a specific orientation, be constructed and operate in a specific orientation, and therefore, cannot be understood as a limitation to the present disclosure.

In the present disclosure, unless otherwise specified and limited, the terms "mounting", "connection", "connection" and "fixation" should be understood in a broad sense, for example, they can be fixed connection, detachable connection, or integration; or they can be mechanical connection or electrical connection; or they can be direct connection, indirect connection through an intermediate medium, or communication of the interiors of two elements or the relationship of interaction between two elements. For those of ordinary skills in the art, the specific meanings of the aforementioned terms in the present disclosure can be understood according to the specific situations.

It should also be noted that, the same component or part is denoted by the same reference numeral in the embodiments of the present disclosure. For the same part in the embodiments of the present disclosure, it is possible that only one of the parts or components is marked with a reference numeral in the drawings as an example, but it should be understood that the reference numeral is equally applicable to other same parts or components.

In the present disclosure, the terms "one embodiment", "some embodiments", "an example", "a specific example" or "some examples" etc. mean that the specific features, structures, materials or characteristics described in connection with this embodiment or example are included in at least one embodiment or example of the present disclosure. In this specification, the schematic representation of the aforementioned terms is not necessarily aimed at the same embodiment or example. Moreover, the described specific features, structures, materials, or characteristics may be combined in any one or more embodiments or examples in a suitable manner. Moreover, different embodiments or examples and features of different embodiments or examples described in this specification can be joined and combined by those skilled in the art without contradicting each other.

As shown in FIGS. 1-6, in one embodiment of the present disclosure, a cosmetic tool is provided, which includes:

- a brush head 10 which can be dipped in a cosmetic substance and can brush the cosmetic substance onto the skin;
- a material core 20 for loading the cosmetic substances, wherein it can be understood that the material core 20 has therein a cavity loaded with the cosmetic substance, wherein the cosmetic substance may be a liquid foundation, isolation, blush, lipstick, highlighter or other kinds of cosmetic substances, which are not listed here one by one;
- a moving sleeve 30, wherein the material core 20 is mounted in the moving sleeve 30, the brush head 10 is located at one end of the moving sleeve 30 and is disposed opposite to the material core 20, an end face of the material core 20 facing the brush head 10 is provided with a discharge port, the discharge port is communicated with the cavity of the material core 20 and is used for exposing the cosmetic substance to be dipped with the brush head 10 conveniently;
- a fixed sleeve 40, wherein the fixed sleeve 40 is sleeved outside the moving sleeve 30, and the moving sleeve 30 is movable along an axial direction, the moving sleeve 30 is disposed coaxially with the fixed sleeve 40, and the outer diameter of the moving sleeve 30 is slightly smaller than the inner diameter of the fixed sleeve 40, so that the moving sleeve 30 is movable along the axial direction in the fixed sleeve 40; and
- a transmission structure through which the fixed sleeve 40, the moving sleeve 30 and the brush head 10 are connected, wherein when the moving sleeve 30 moves along the axial direction, the moving sleeve 30 drives the brush head 10 to turn over through the transmission structure, so as to dip in the cosmetic substance at the discharge port.

In the cosmetic tool of the embodiments of the present disclosure, when it needs for the brush head 10 to dip in a cosmetic substance, the moving sleeve 30 is driven to move along the axial direction, and at the same time, the axial movement of the moving sleeve 30 transmits an overturning driving force to the brush head 10 through the transmission structure, thereby driving the brush head 10 to turn over, and when the brush head 10 turns over to the discharge port of the material core 20, the brush head 10 is dipped in the cosmetic substance at the discharge port of the material core 20, thereby realizing the dipping of the cosmetic substance; and after the brush head 10 is dipped in the cosmetic substance, then the moving sleeve 30 is driven to move in the opposite direction, so that the brush head 10 is driven to turn over reversely, and when the brush head 10 turns over reversely to a certain position, at this time the cosmetic substance on the brush head 10 can be directly coated on the skin. For the cosmetic tool of the embodiments of the present disclosure, when in use, the dipping of the cosmetic substance can be realized by driving the moving sleeve 30 to move, so that the operation of the cosmetic tool is simple. Additionally, the material core 20 and the brush head 10 are integrated in one component of the cosmetic tool, and thus is convenient to carry when going out.

Figure 2:
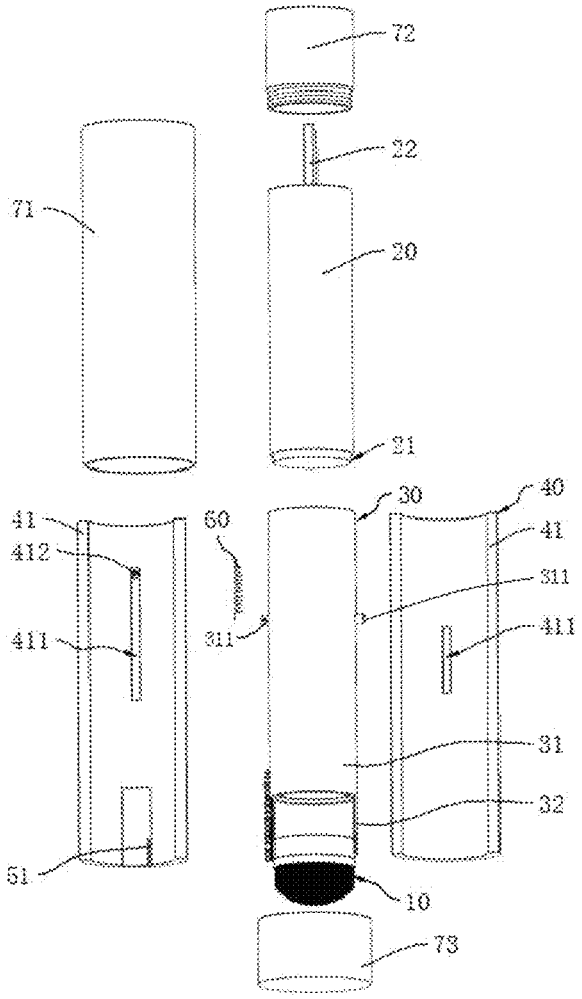
FIG. 2 is an exploded view of the cosmetic tool as shown in FIG. 1.
Figure 3:
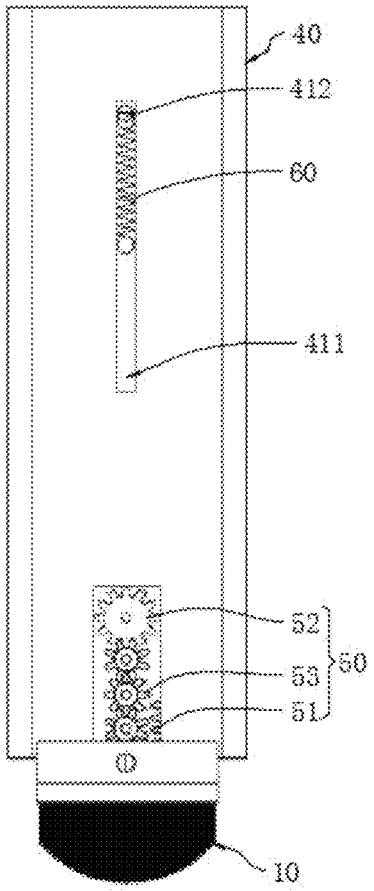
FIG. 3 is a cross-sectional view of the cosmetic tool as shown in FIG. 1.
Figure 4:
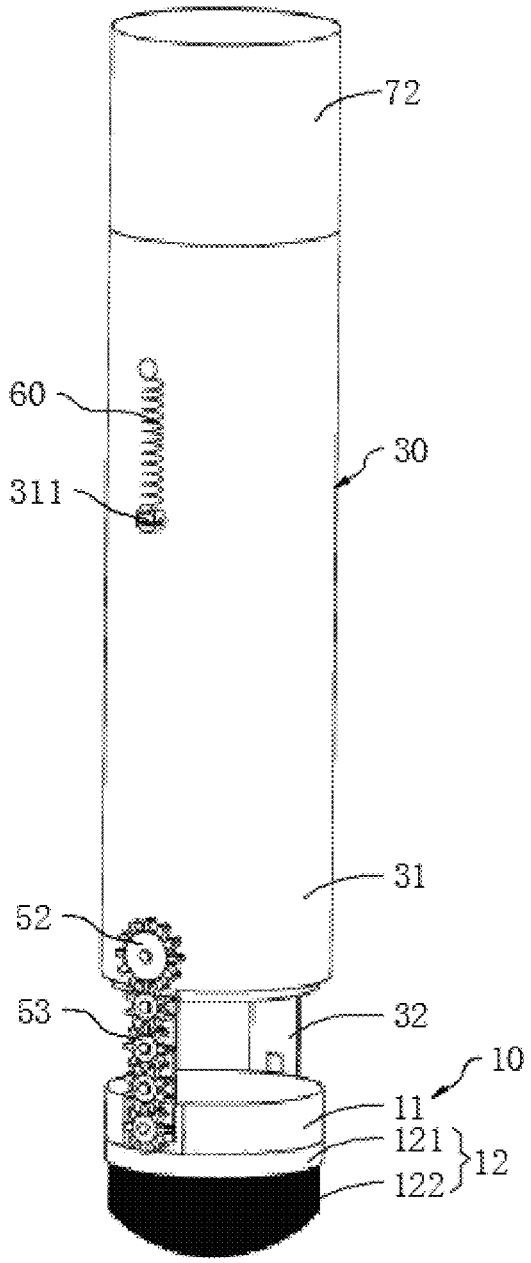
FIG. 4 is a schematic structural diagram of the cosmetic tool as shown in FIG. 1 after the outer shell and the fixed shell are hided.

In another embodiment of the present disclosure, as shown in FIGS. 2, 3 and 4, the provided transmission structure of the cosmetic tool is a transmission mechanism 50 through which the fixed sleeve 40, the moving sleeve 30 and the brush head 10 are connected, wherein when the moving sleeve 30 moves along the axial direction, the moving sleeve 30 drives the brush head 10 to turn over through the transmission mechanism 50, so as to dip in the cosmetic substance at the discharge port.

In the cosmetic tool of the embodiments of the present disclosure, when it needs for the brush head 10 to dip in a cosmetic substance, the moving sleeve 30 is driven to move along the axial direction, and at the same time, the axial movement of the moving sleeve 30 transmits an overturning driving force to the brush head 10 through the transmission mechanism 50, thereby driving the brush head 10 to turn over, and when the brush head 10 turns over to the discharge port of the material core 20, the brush head 10 is dipped in the cosmetic substance at the discharge port of the material core 20, thereby realizing the dipping of the cosmetic substance; and after the brush head 10 is dipped in the cosmetic substance, then the moving sleeve 30 is driven to move in the opposite direction, so that the brush head 10 is driven to turn over reversely, and when the brush head 10 turns over reversely to a certain position, at this time the cosmetic substance on the brush head 10 can be directly coated on the skin. For the cosmetic tool of the embodiments of the present disclosure, when in use, the dipping of the cosmetic substance can be realized by driving the moving sleeve 30 to move, so that the operation of the cosmetic tool is simple. Additionally, the material core 20 and the brush head 10 are integrated in one component of the cosmetic tool, and thus is convenient to carry when going out.

In another embodiment of the present disclosure, as shown in FIGS. 2, 3 and 4, the transmission mechanism 50 of the provided cosmetic tool includes a rack 51 and an engaging gear 52 for engaging and mating with the rack 51. The rack 51 is disposed on an inner wall of the fixed sleeve 40 and extends along the axial direction of the moving sleeve 30, and the engaging gear 52 is mounted on the outer wall of the moving sleeve 30 and connected with the brush head 10. When the moving sleeve 30 moves along the axial direction, the rack 51 drives the engaging gear 52 to rotate, and the engaging gear 52 drives the brush head 10 to turn over. Specifically, when it needs for the brush head 10 to dip in the cosmetic substance, since the engaging gear 52 is engaged with the rack 51, the moving sleeve 30 is driven to move towards the direction of the brush head 10, the engaging gear 52 rotates as driven by the rack 51, and the rotation of the engaging gear 52 drives the brush head 10 to turn over, thereby realizing turning the brush head 10 over and dipping the same in the cosmetic substance; and by adopting the transmission mode of the engaging gear 52 and the rack 51, there are good reliability of power transmission and good stability and reliability of turning over of the brush head 10.

In another embodiment of the present disclosure, as shown in FIGS. 2, 3 and 4, the transmission mechanism 50 of the provided cosmetic tool includes multiple transmission gears 53. The engaging gear 52 and the multiple transmission gears 53 are sequentially engaged along the direction of the material core 20 toward the brush head 10 and along the axial direction of the moving sleeve 30, the outer diameter of each of the transmission gears 53 is smaller than that of the engaging gear 52, and one of the transmission gears 53 is connected with the brush head 10. It can be understood that the transmission gear 53 is not engaged with the rack 51, and the engaging gear 52 is engaged with the rack 51. When it needs for the brush head 10 to dip in the cosmetic substance, the transmission gear 53 passes over the rack 51 when the moving sleeve 30 moves. At this time, the engaging gear 52 is not engaged with the rack 51, and the brush head 10 will not turn over. Only after the moving sleeve 30 continues to move to a certain position, that is, when the engaging gear 52 is engaged with the rack 51, the moving sleeve 30 can drive the engaging gear to rotate. During the rotation of the engaging gear 52, the transmission gear 53 is driven to rotate, and the rotated transmission gear 53 drives the brush head 10 to turn over, thereby realizing turning the brush head 10 over and dipping the same in the cosmetic substance. In this process, for a certain distance at which the moving sleeve 30 does not drive the brush head 10 to turn over, the moving sleeve 30 can drive the brush head 10 to be exposed at a certain distance outside the fixed sleeve 40, so that the brush head 10 can turn over outside the fixed sleeve 40, and the turning over of the brush head 10 will not interfere with the fixed sleeve 40.

In this embodiment, the number of the transmission gears 53 is one, two or more than three, and the number of the transmission gears 53 can be selected according to actual needs, which is not limited here. Illustratively, the number of the transmission gears 53 is four.

Figure 5:
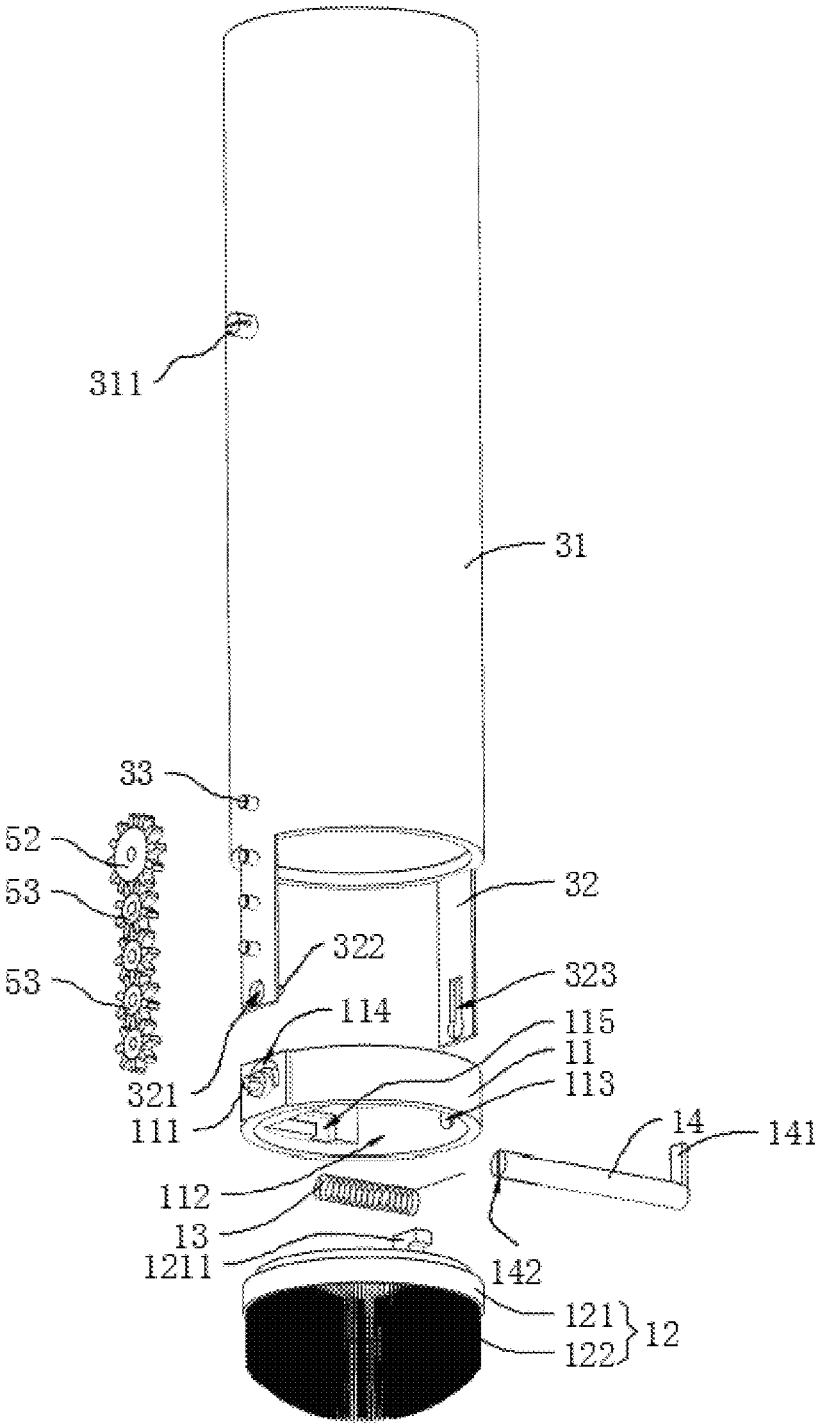
FIG. 5 is an exploded view of the moving sleeve and the brush head in the cosmetic tool as shown in FIG. 1.
Figure 6:
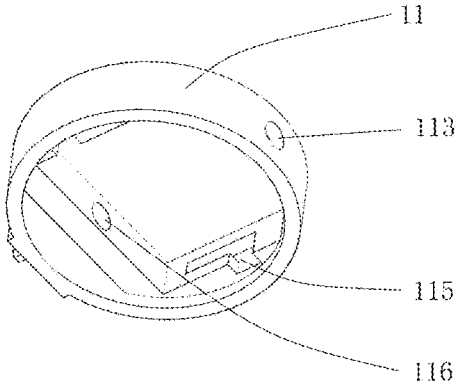
FIG. 6 is a schematic structural view of the brush head holder in the cosmetic tool as shown in FIG. 2.

In another embodiment of the present disclosure, as shown in FIGS. 4, 5 and 6, the brush head 10 of the provided cosmetic tool includes a brush head holder 11 and a dipping member 12 for dipping in the cosmetic substance. The outer peripheral wall of the brush head holder 11 is provided with a connecting post 111, the inner wall of the moving sleeve 30 is provided with a connecting hole 321, and the connecting post 111 passes through the connecting hole 321 and is then connected with the transmission gear 53. Specifically, the rotation of the transmission gear 53 drives the connecting post 111 to rotate in the connecting hole 321, and during the rotation process of the connecting post 111, the brush head holder 11 is driven to turn over, so that the dipping member 12 turns over toward the material core 20. When the dipping member 12 rotates to the discharge port, the dipping member 12 dips in the cosmetic substance at the discharge port, thereby realizing the dipping of the cosmetic substance.

In another embodiment of the present disclosure, as shown in FIGS. 4, 5 and 6, the brush head 10 of the provided cosmetic tool further includes a first elastic member 13 and a connecting shaft 14, the brush head holder 11 has an opening-shaped mounting cavity 112, and the dipping member 12 is mounted as covering the opening of the mounting cavity 112. Specifically, the dipping member 12 includes a fixing plate 121 and a dipping portion 122 fixed on the fixing plate 121. The fixing plate 121 is disposed as covering and closing the opening of the mounting cavity 112 to prevent the cosmetic substance from entering the mounting cavity 112 and thus affecting the movement of the connecting shaft 14 and the first elastic member 13, wherein, the dipping portion 122 is bristles, sponge eggs, sponge blocks or other components that can dip in the cosmetic substance and brush the cosmetic substance onto the skin.

In this embodiment, the brush head holder 11 is provided with a rotating hole 113 communicated with the mounting cavity 112, the rotating hole 113 is disposed opposite to the connecting post 111, the connecting shaft 14 is inserted into the mounting cavity 112 from the rotating hole 113, and one end of the connecting shaft 14 facing the rotating hole 113 is fixedly connected with the moving sleeve 30. It can be understood that, the inner wall of the mounting cavity is provided with a fixing hole 116, the fixing hole 116 is disposed as directly facing the rotating hole 113, and the fixing hole 116, the rotating hole 113 and the connecting post 111 are all coaxially disposed, the two ends of the connecting shaft 14 penetrate the fixing hole 116 and the rotating hole 113 respectively, and the inner diameters of both the fixing hole 116 and the rotating hole 113 are slightly larger than the outer diameter of the connecting shaft 14, so that when the brush head holder 11 rotates as driven by the connecting post 111, the brush head holder 11 can rotate around the axis of the connecting shaft 14, the two opposite sides of the brush head holder 11 are respectively subjected to the supporting action of the connecting post 111 and the connecting shaft 14, and thus the stability and reliability of the rotation of the brush head holder 11 are good. An end portion of the connecting shaft 14 is provided with an elongated plate 141, the outer wall of the moving sleeve 30 is provided with an elongated hole 323, and the elongated plate 141 is embedded and fixed in the elongated hole 323, thereby realizing the fixed connection between the connecting shaft 14 and the moving sleeve 30; and, in the mounting process, the end portion of the connecting shaft 14 passes through the elongated hole 323 into the moving sleeve 30, then is inserted into the mounting cavity 112 through the rotating hole 113 and then inserted into the fixing hole 116. The mounting operation of the connecting shaft 14 is simple and reliable, and the structure reliability is good.

In this embodiment, the first elastic member 13 is sleeved on the connecting shaft 14, one end of the connecting shaft 14 facing away from the rotating hole 113 is connected with one end of the first elastic member 13, the other end of the first elastic member 13 is connected with the brush head holder 11, and the first elastic member 13 is used for driving the brush head holder 11 to turn over reversely, so that the dipping member 12 is disposed as facing away from the material core 20. Specifically, when the dipping member 12 turns over towards the discharge port, the brush head holder 11 rotates to drive the first elastic member 13 to twist. After the cosmetic substance is dipped with the dipping member 12, the brush head holder 11 automatically drives the brush head holder 11 and the dipping member 12 to turn over reversely and returns back to the original position under the restoring action of the first elastic member 13. That is, the first elastic member 13 can ensure that the brush head 10 can automatically reset after dipping in the cosmetic substance, which is convenient for the subsequent brushing of the cosmetic substance.

In this embodiment, the first elastic member 13 is an elastic component such as a spring; when the first elastic member 13 is a spring, an end face of the connecting shaft 14 is provided with a fixing groove 142, one end of the spring is hung in the fixing groove 142, a cavity wall of the mounting cavity 112 is provided with a hanging structure, and the other end of the spring is hung on the hanging structure, thereby realizing the fixed mounting of the spring.

In another embodiment of the present disclosure, as shown in FIGS. 4, 5 and 6, the provided dipping member 12 for the cosmetic substance is detachably connected with the brush head holder 11. Specifically, the fixing plate 121 is detachably connected with the brush head holder 11. That is, the dipping member 12 can be detached from the brush head holder 11 for replacement. On one hand, different types of dipping members 12 can be replaced, so as to meet different cosmetic requirements and improve the universality and disclosure range of the cosmetic tool. On the other hand, it is also convenient to clean the dipping member 12.

In this embodiment, the fixing plate 121 is provided with a buckle 1211 thereon, and the brush head holder 11 is provided with a clamping groove 115 clamped with the buckle 1211. The brush head holder 11 and the fixing plate 121 are connected by the buckling of the buckle 1211 and the clamping groove 115, so that the fixing plate 121 can be detached from the brush head holder 11 to facilitate the replacement of the fixing plate 121. The brush head holder 11 is cylindrical shaped, an end face of the brush head holder 11 is provided with a mounting cavity 112, the clamping groove 115 is disposed on the inner peripheral wall of the mounting cavity 112, the fixing plate 121 is plate-shaped, the dipping portion 122 and the buckle 1211 are respectively located on the two opposite surfaces of the fixing plate 121, wherein the buckle 1211 includes a horizontal section and a vertical section, one end of the horizontal section is vertically connected with the fixing plate 121 and the other end of the horizontal section is connected with the vertical section; the clamping groove 115 includes an axial section and a circumferential section, the axial section extends along the axis of the mounting cavity 112 and the circumferential section extends along the circumferential direction of the mounting cavity 112. Then when the dipping member 12 is mounted on the brush head holder 11, an end portion of the vertical section is first inserted into the axial section and moves along the axial direction. After the vertical section moves to an end portion of the axial section, the fixing plate 121 is rotated to clamp the vertical section into the circumferential section, thereby realizing the fixing of the fixing plate 121 relative to the brush head holder 11. When the dipping member 12 needs to be replaced, the fixing plate 121 is rotated reversely, so that the end portion of the vertical section rotates to the connection of the circumferential section and the axial section, and then the end portion of the vertical section is moved out along the axial section.

In this embodiment, the number of the buckles 1211 can be two, three or more than four, the buckles 1211 are disposed at intervals along the circumferential direction of the fixing plate 121, the buckles 1211 are disposed in one-to-one correspondence with the clamping grooves 115, and the number of the buckles 1211 is multiple, so that the reliability of the connection between the fixing plate 121 and the brush head holder 11 is better. Considering processing and structural strength, it is preferable that the number of buckles 1211 is two, and the buckles are located on the opposite sides of the moving sleeve 30.

Of course, in other embodiments, the fixing plate 121 may also be fixedly connected with the brush head holder 11. For example, the fixing plate 121 and the brush head holder 11 are integrally molded by injection molding or 3D printing, or the fixing plate 121 is connected with the brush head holder 11 by welding. As such, the fixing plate 121 and the brush head holder 11 are not detachable, and the dipping member 12 is not replaceable.

In another embodiment of the present disclosure, as shown in FIGS. 4, 5 and 6, the outer peripheral wall of the brush head holder 11 of the provided cosmetic tool is provided with a semicircular groove 114 centered on a rotation axis around which the brush head holder 11 rotates, and the inner wall of the moving sleeve 30 is provided with a limiting post 322 that is inserted into the semicircular groove 114 and movable in the semicircular groove 114 along with the rotation of the brush head holder 11 to limit the overturning angle of the brush head holder 11. During the rotation of the brush head holder 11, the limiting post 322 moves along the semicircular groove 114, and when the limiting post 322 moves to both ends of the semicircular groove 114, the limiting post 322 cannot continue to move in the semicircular groove 114, so that the brush head holder 11 cannot continue to rotate, thereby realizing the limitation of the overturning angle of the brush head 10. In the specific disclosure, when the limiting post 322 is located at one end of the semicircular groove 114, at this time the dipping member 12 is disposed as facing away from the material core 20 and the dipping member 12 can brush the cosmetic substance on the dipping member 12 onto the skin; when the limiting post 322 moves along the semicircular groove 114 to the other end of the semicircular groove 114, at this time, the dipping member 12 is disposed as directly facing the discharge port and dipping in the cosmetic substance from the discharge port, so that the brush head 10 is accurately stopped at the discharge port to dip in the cosmetic substance through the cooperation between the limiting post 322 and the semicircular groove 114.

In this embodiment, the moving sleeve 30 includes a sleeve body 31 and moving arms 32 disposed on two opposite sides of the sleeve body 31, the brush head 10 is located between the two moving arms 32, and a connecting hole 321 and a limiting post 322 are disposed on the same moving arm 32; the other moving arm 32 is provided with an elongated hole 323 thereon, and a gap formed between the two moving arms 32 can provide a turnover space for the turnover of the brush head 10, so that the turnover of the brush head 10 is smoother and more reliable, wherein, the outer surface of each of the sleeve body 31 and the moving arms 32 is provided with an assembly column 33, and an engaging gear 52 and a transmission gear 53 are rotatably mounted on the assembly column 33 respectively in one-to-one correspondence, and, after the brush head 10 is dipped in the cosmetic substance and turns over reversely, since the transmission gear 53 is not engaged with the rack 51, when the moving sleeve 30 retracts into the fixed sleeve 40 for a certain distance, the brush head 10 will not turn over, and at the same time, the moving arm 32 will retract into the fixed sleeve 40 accordingly, so that the moving arm 32 will not be exposed out of the fixed sleeve 40, thereby improving the aesthetics of the whole cosmetic tool.

In another embodiment of the present disclosure, the inner wall of the moving sleeve 30 of the brush head holder 11 of the provided cosmetic tool is provided with a semicircular groove 114 centered on a rotation axis around which the brush head holder 11 rotates, the outer peripheral wall of the brush head holder 11 is provided with a limiting post 322 that is inserted into the semicircular groove 114 and movable in the semicircular groove 114 along with the rotation of the brush head holder 11 to limit the overturning angle of the brush head holder 11. During the rotation of the brush head holder 11, the limiting post 322 moves along the semicircular groove 114, and when the limiting post 322 moves to both ends of the semicircular groove 114, the limiting post 322 cannot continue to move in the semicircular groove 114, so that the brush head holder 11 cannot continue to rotate, thereby realizing the limitation of the overturning angle of the brush head 10. In the specific disclosure, when the limiting post 322 is located at one end of the semicircular groove 114, at this time the dipping member 12 is disposed as facing away from the material core 20 and the dipping member 12 can brush the cosmetic substance on the dipping member 12 onto the skin; when the limiting post 322 moves along the semicircular groove 114 to the other end of the semicircular groove 114, at this time, the dipping member 12 is disposed as directly facing the discharge port and dipping in the cosmetic substance from the discharge port, so that the brush head 10 is accurately stopped at the discharge port to dip in the cosmetic substance through the cooperation between the limiting post 322 and the semicircular groove 114.

In another embodiment of the present disclosure, as shown in FIGS. 2 and 3, the inner wall of the fixed sleeve 40 of the provided cosmetic tool is provided with a guide groove 411 extending along an axial direction, the outer peripheral wall of the moving sleeve 30 is provided with a guide protrusion 311, and the guide protrusion 311 is inserted into the guide groove 411. Specifically, the guide protrusion 311 is disposed on the outer periphery of the sleeve body 31, and with the cooperation of the guide protrusion 311 and the guide groove 411, the axial movement of the moving sleeve 30 is stable and reliable. Additionally, under the limit of the guide protrusion 311 and the guide groove 411, the moving sleeve 30 cannot rotate along a circumferential direction relative to the fixed sleeve 40, thereby ensuring that the engaging gear 52 can be stably engaged with the rack 51.

In this embodiment, the guide groove 411 is disposed corresponding to the guide protrusion 311, the number of the guide protrusion 311 may be two, three or more than four, and the guide protrusions 311 are distributed at intervals along the circumferential direction of the moving sleeve 30. Illustratively, the number of the guide protrusion 311 is two.

In another embodiment of the present disclosure, the inner wall of the fixed sleeve 40 of the provided cosmetic tool is provided with a guide protrusion 311, and the outer peripheral wall of the moving sleeve 30 is provided with a guide groove 411 extending along an axial direction. Specifically, the guide groove 411 is disposed on the outer periphery of the sleeve body 31, and with the cooperation of the guide protrusion 311 and the guide groove 411, the axial movement of the moving sleeve 30 is stable and reliable. Additionally, under the limit of the guide protrusion 311 and the guide groove 411, the moving sleeve 30 cannot rotate along a circumferential direction relative to the fixed sleeve 40, thereby ensuring that the engaging gear 52 can be stably engaged with the rack 51.

In another embodiment of the present disclosure, as shown in FIGS. 2 and 3, the provided cosmetic tool further includes a second elastic member 60 located in the guide groove 411, one end of the second elastic member 60 is connected with the fixed sleeve 40, and the other end of the second elastic member 60 is connected with the guide protrusion 311, and the second elastic member 60 is used for driving the moving member to move away from the brush head 10. Specifically, when the moving sleeve 30 is pushed to move towards the brush head 10, the second elastic member 60 is stretched, and when the moving sleeve 30 moves into position, that is, after the brush head 10 dips in the cosmetic substance, the second elastic member 60 drives the moving sleeve 30 to move reversely under the action of its own restoring force, thereby realizing the automatic reset of the moving sleeve 30 and making the use of the cosmetic tool simple and convenient. The second elastic member 60 is an elastic component, such as a spring.

In this embodiment, an upper end of the guide groove 411 is provided with a hooking protrusion 412, and the two ends of the elastic member are hooked between the hooking protrusion 412 and the guide protrusion 311, respectively, thereby achieving the fixing of the elastic member.

In this embodiment, the fixed sleeve 40 includes two semicircular plates 41, which are spliced to form the fixed sleeve 40. The fixed sleeve 40 is disposed in a splitting type, which is convenient for the mounting and arrangement of the transmission mechanism 50 and the moving sleeve 30.

In another embodiment of the present disclosure, the material core 20 of the provided cosmetic tool is detachably connected with the moving sleeve 30, thereby facilitating the replacement of the material core 20.

In this embodiment, as shown in FIGS. 1, 2 and 3, the material core 20 is directly inserted into the sleeve body 31, an end portion of the sleeve body 31 facing the moving arm 32 is provided with a convex edge, and an end portion of the material core 20 is provided with a concave edge 21. When the material core 20 is inserted into position in the sleeve body 31, the convex edge is clamped in the concave edge 21, so that the material core 20 cannot be detached from the opening of the sleeve body 31 facing the moving arm 32. The cosmetic tool further includes a material core cover 72, which is screwed to the end portion of the sleeve body 31 facing away from the moving arm 32, thereby preventing the material core 20 from moving out of the moving sleeve 30. Additionally, the end face of the material core 20 facing away from the discharge port is provided with a handle 22, which is exposed outside the moving sleeve 30 and abuts against the material core cover 72, while the other end of the material core 20 abuts against the convex edge, thereby realizing the axial fixation of the material core 20 in the sleeve body 31. The fixation structure is simple and convenient to manufacture. Additionally, the handle 22 is exposed outside the moving sleeve 30, so that the material core 20 can be directly pulled out of the sleeve body 31 for replacement of the material core 20, thereby realizing movable replacement of the material core 20. The structural design is ingenious, so that the use of the cosmetic tool has better convenience. The material core cover 72 is also sleeved with an outer cover, which is an aluminum alloy outer cover, a plastic outer cover, an iron outer cover or an outer cover made of other materials, so as to enhance the aesthetics of the appearance of the cosmetic tool.

In another embodiment of the present disclosure, the material core 20 of the provided cosmetic tool can also be fixedly connected with the moving sleeve 30. For example, the material core 20 may also be integrally molded with the sleeve body 31 by injection molding or 3D printing, or the material core 20 may be connected with the sleeve body 31 by welding. In this way, the material core 20 and the moving sleeve 30 are not detachable, and the material core 20 is not replaceable.

In this embodiment, as shown in FIGS. 1 and 2, the fixed sleeve 40 is externally sleeved with an outer shell 71, which can improve the aesthetics of the appearance of the cosmetic tool. For example, the outer shell 71 may be a metal outer shell or a plastic outer shell, for example an aluminum outer shell, an iron outer shell, a silica gel outer shell, etc.

In this embodiment, as shown in FIGS. 1 and 2, the cosmetic tool further includes a brush head cover 73, which covers the brush head 10 and is connected with the fixed sleeve 40 in a clamping manner. The brush head cover 73 enables the brush head 10 to be not exposed and in an enclosed environment, so that the cleanliness of the brush head 10 is better and the use safety is better.

Figure 7:
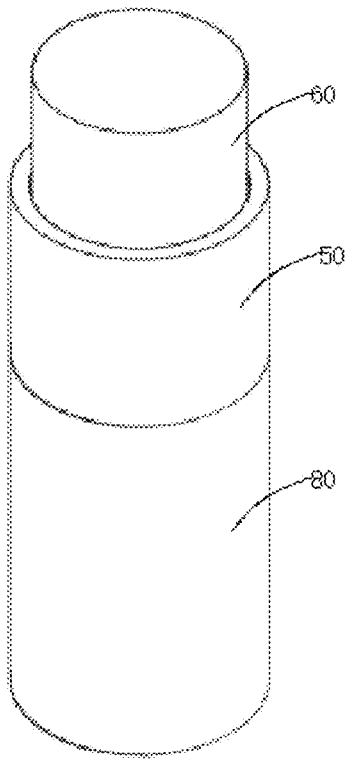
FIG. 7 is a schematic structural diagram of a cosmetic tool provided by another embodiment of the present disclosure.
Figure 8:
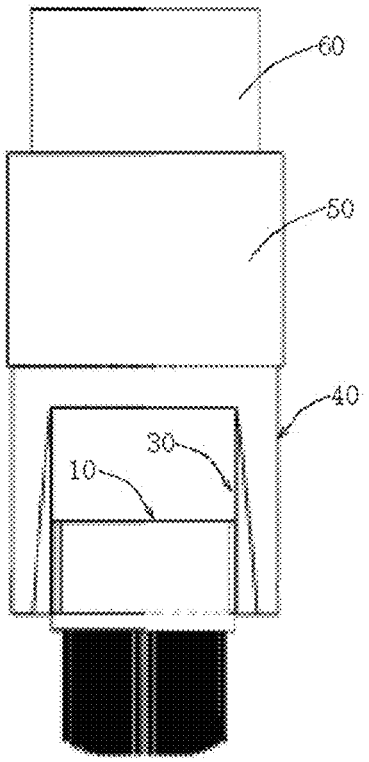
FIG. 8 is a schematic structural diagram of the cosmetic tool as shown in FIG. 7 after the brush head cover is hided.
Figure 9:
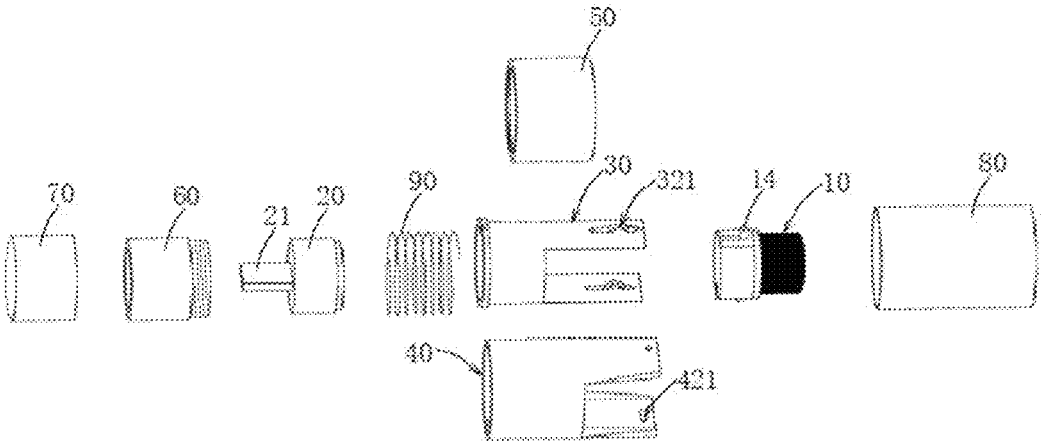
FIG. 9 is an exploded view of the cosmetic tool as shown in FIG. 7.

As shown in FIGS. 7-16, in another embodiment of the present disclosure, specifically referring to FIGS. 7-9, a cosmetic tool is provided, which includes:

- a brush head 10, as can be understood, which can dip in a cosmetic substance and can brush the cosmetic substance onto the skin of a user;
- a material core 20 for loading a cosmetic substance, wherein it can be understood that the material core 20 has therein a cavity which can load the cosmetic substance; wherein, the cosmetic substance may be blush, liquid, lipstick, a highlighter and other types of cosmetic substances, which are not listed here one by one;
- a moving sleeve 30, wherein the material core 20 is mounted in the moving sleeve 30, the brush head 10 is rotatably connected with one end of the moving sleeve 30 and disposed opposite to the material core 20, an end face of the material core 20 facing the brush head 10 is provided with a discharge port for the brush head 10 to dip in the cosmetic substance, wherein, it should be noted that the brush head 10 is provided with a dipping member 13 capable of dipping in the cosmetic substance and brushing the cosmetic substance onto the skin; when it does not need for the brush head 10 to dip in the cosmetic substance, the dipping member 13 is exposed outside the moving sleeve 30, so as to brush the cosmetic substance; and when it needs for the brush head 10 to dip in the cosmetic substance at the discharge port of the material core 20, the brush head 10 turns over by 180° towards the material core 20, so that the dipping member 13 turns over into the moving sleeve 30 and dips in the cosmetic substance at the discharge port of the material core 20; specifically, the material core 20 and the brush head 10 are sequentially disposed at intervals along the axial direction of the moving sleeve 30, the discharge port on the material core 20 is communicated with the cavity, and the cosmetic substance can be exposed from the discharge port, thereby facilitating the dipping of the dipping member 13; and the dipping member 13 can be bristles, sponge eggs or sponge puff and other components that can coat the cosmetic substance, and is not limited here;
- a fixed sleeve 40, wherein the fixed sleeve 40 is sleeved outside the moving sleeve 30, and the moving sleeve 30 is movable along an axial direction. It can be understood that the fixed sleeve 40 is sleeved outside the moving sleeve 30, and the outer diameter of the moving sleeve 30 is smaller than the inner diameter of the fixed sleeve 40, so that the moving sleeve 30 can slide axially; wherein, the fixed sleeve 40 is also sleeved with an outer shell 50, which is an aluminum alloy outer shell 50, a plastic outer shell 50, an iron outer shell 50 or an outer shell made of other materials, so as to increase the aesthetics of the appearance of the cosmetic tool. The moving sleeve 30 and the fixed sleeve 40 may be square sleeves, circular sleeves, oval sleeves, or other hollow cylindrical structures of other shapes, which are not limited here.

The brush head 10 is provided with a connecting shaft 14, and a rotating structure includes a semicircular hole 321 and a limiting groove 421; the semicircular hole 321 is disposed on the inner wall of the moving sleeve 30 and centered on the rotation axis around which the brush head 10 rotates, a connecting line between both ends of the semicircular hole 321 is parallel to the axial direction of the moving sleeve 30, the limiting groove 421 is disposed on the inner wall of the fixed sleeve 40, the limiting groove 421 is perpendicular to the axial direction of the moving sleeve 30, and the end portion of the connecting shaft 14 penetrates the semicircular hole 321 and the limiting groove 421. The limiting groove 421 can be a straight groove or an arc groove extending along the circumferential direction of the fixed sleeve 40.

The cosmetic tool according to the embodiments of the present disclosure will be further described below. For the cosmetic tool, the end portion of the connecting shaft 14 on the brush head 10 penetrates the semicircular hole 321 and the limiting groove 421, the limiting groove 421 is perpendicular to the axial direction of the moving sleeve 30, the semicircular hole 321 is centered on the rotation axis around which the brush head 10 rotates, and the connecting line between both ends of the semicircular hole 321 is parallel to the axial direction of the moving sleeve 30, so that when it needs for the brush head 10 to dip in the cosmetic substance at the discharge port of the material core 20, the moving sleeve 30 is pushed to move along the axial direction and towards the brush head 10, thereby realizing the turning over and dipping of the brush head 10. In this process, the connecting shaft 14 on the brush head 10 is limited by the limiting groove 421, so that the brush head 10 will not move along with the moving sleeve 30 along the axial direction. At the same time, as driven by the semicircular hole 321, the connecting shaft 14 on the brush head 10 moves from one end to the other end along the semicircular hole 321, so as to drive the brush head 10 to turn over relative to the moving sleeve 30, and the overturned brush head 10 dips in the cosmetic substance at the discharge port of the material core 20, thereby realizing the dipping in the cosmetic substance with the brush head 10. For the cosmetic tool according to the embodiments of the present disclosure, the turnover of the brush head 10 can be realized through the connection and cooperation among the connecting shaft 14 on the brush head 10, the semicircular hole 321 on the moving sleeve 30 and the limiting groove 421 on the fixed sleeve 40, and thus the cosmetic tool has the advantages of a simple structure, convenient manufacture, few parts, simple transmission, good use reliability and long service life.

For the cosmetic tool of the embodiments of the present disclosure, when in use, the dipping of the cosmetic substance can be realized by driving the moving sleeve 30 to move, so that the operation of the cosmetic tool is simple. Additionally, the material core 20 and the brush head 10 are integrated in one component of the cosmetic tool, and thus is convenient to carry when going out.

Figure 10:
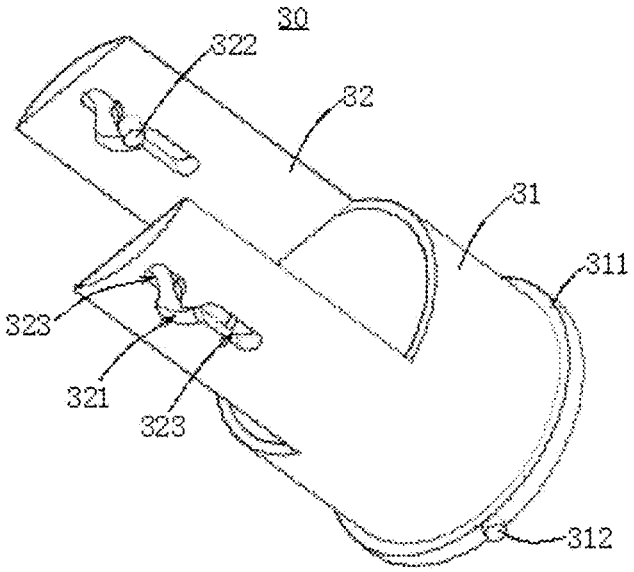
FIG. 10 is a schematic structural diagram of the moving sleeve as shown in FIG. 9 from a first perspective.
Figure 15:
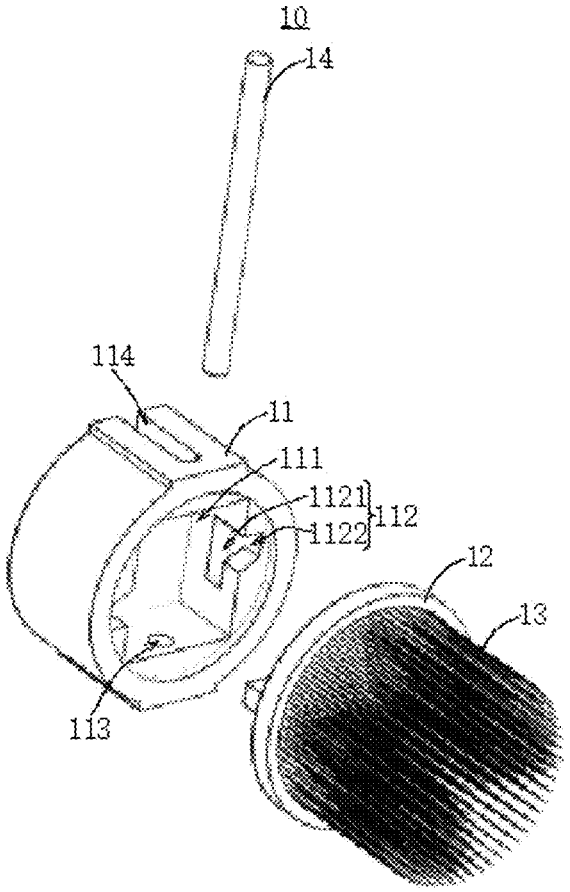
FIG. 15 is an exploded view of the brush head as shown in FIG. 14 from a fifth perspective.

In another embodiment of the present disclosure, as shown in FIGS. 9, 10 and 15, the inner wall of the moving sleeve 30 of the provided cosmetic tool is provided with a rotation post 322, the peripheral wall of the brush head 10 is provided with a rotation groove 114, and the rotation post 322 is rotatably connected in the rotation groove 114. Specifically, the rotation post 322 is inserted in the rotation groove 114 and can rotate in the rotation groove 114, and the rotation post 322 is disposed in parallel with the connecting shaft 14 at intervals. Through the rotating cooperation between the rotation post 322 and the rotation groove 114, the rotatable connection between the brush head 10 and the moving sleeve 30 is realized, which has a simple structure and is convenient to manufacture.

In another embodiment of the present disclosure, the inner wall of the moving sleeve 30 of the provided cosmetic tool is provided with a rotation groove 114, and the peripheral wall of the brush head 10 is provided with a rotation post 322 which is rotatably connected in the rotation groove 114. Specifically, the rotation post 322 is inserted in the rotation groove 114 and can rotate in the rotation groove 114, and the rotation post 322 is disposed in parallel with the connecting shaft 14 and at intervals along the axial direction of the moving sleeve 30. Through the rotating cooperation between the rotation post 322 and the rotation groove 114, the rotatable connection between the brush head 10 and the moving sleeve 30 is realized, which has a simple structure and is convenient to manufacture.

In another embodiment of the present disclosure, as shown in FIGS. 9, 10 and 15, the rotation groove 114 of the provided cosmetic tool is an elongated groove. The rotation groove 114 is parallel to the axial direction of the moving sleeve 30; the inner wall of the moving sleeve 30 is also provided with a linear hole 323, which is communicated with the end portion of the semicircular hole 321 and extends along the axial direction of the moving sleeve 30 and away from the semicircular hole 321. Specifically, the linear hole 323 can be located between the semicircular hole 321 and the material core 20, or at the side of the semicircular hole 321 facing away from the material core 20. When the linear hole 323 is located between the semicircular hole 321 and the material core 20, and the moving sleeve 30 moves until the brush head 10 is turned over by 180° and dips in the cosmetic material, because the rotation post 322 can continue to move along the rotation groove 114 while the connecting shaft 14 can also continue to move along the linear hole 323, the moving sleeve 30 can continue to move along the axial direction, and thus the brush head 10 is driven to continually move towards the discharge port of the material core 20. Therefore, the amount of the cosmetic substance dipped with the brush head 10 can be adjusted by controlling the moving distance of the moving sleeve 30. When the moving sleeve 30 continues to move for a large distance, the pressing force by which the brush head 10 is tightly pressed at the discharge port is large, and more cosmetic substance is dipped by the brush head 10; and when the moving sleeve 30 continues to move for a short distance, the pressing force by which the brush head 10 is tightly pressed at the discharge port is small, and less cosmetic substance is dipped by the brush head 10. When the linear hole 323 is located at the side of the semicircular hole 321 facing away from the material core 20, and after the brush head 10 turns over reversely by 180° as driven by the moving sleeve 30 so that the brush head 10 is exposed outside the moving sleeve 30, since the rotation post 322 can continue to move along the rotation groove 114 while the connecting shaft 14 can also continue to move along the linear hole 323, the moving sleeve 30 can continue to move along the axial direction, so as to drive the brush head 10 to continually move towards the outside of the moving sleeve 30, so that the exposed part of the dipping member 13 of the brush head 10 can be gradually increased, thereby facilitating the brushing of the cosmetic substance. Meanwhile, during the brushing process of the cosmetic substance, components such as the moving sleeve 30 and the fixed sleeve 40 will not rub against the skin, thereby improving the brushing comfort of the cosmetic substance. After the rotation post 322 enters the rotation groove 114 and the connecting shaft 14 also enters the linear hole 323, the brush head 10 will not turn over when the cosmetic substance is brushed, which makes the operation of brushing the cosmetic substance simpler and easier.

In another embodiment of the present disclosure, as shown in FIGS. 9, 10 and 15, both ends of the semicircular hole 321 of the provided cosmetic tool are communicated with the linear hole 323. Specifically, the number of the linear holes 323 is two, wherein one linear hole 323 can be located between the semicircular hole 321 and the material core 20, and the other linear hole 323 is located at the side of the semicircular hole 321 facing away from the material core 20. From the above analysis, it can be seen that in the cosmetic tool, the amount of cosmetic substance dipped by the brush head 10 can be adjusted, and at the same time, the brush head 10 will not turn over during the process of brushing the cosmetic substance onto the skin by the brush head 10, so that the operation of brushing the cosmetic substance by the brush head 10 is simpler and easier.

Figure 11:
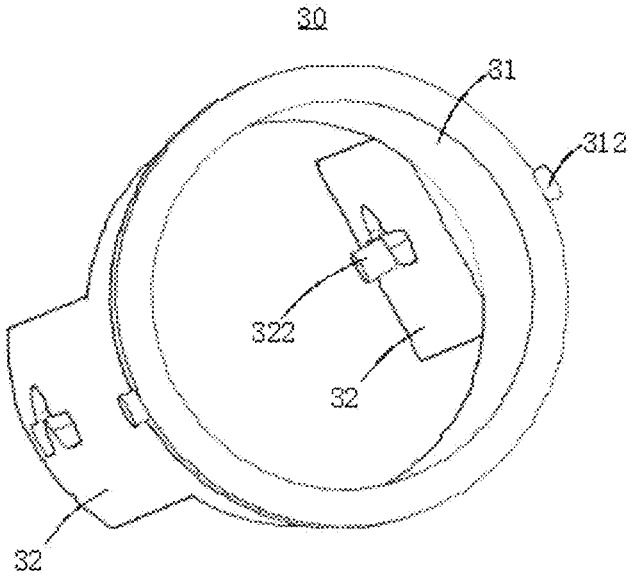
FIG. 11 is a schematic structural diagram of the moving sleeve as shown in FIG. 9 from a second perspective.

In another embodiment of the present disclosure, as shown in FIGS. 10 and 11, the moving sleeve 30 of the provided cosmetic tool includes a moving sleeve body 31 and two moving arms 32. The two moving arms 32 are respectively connected with two opposite sides of the moving sleeve body 31, and extend along the axial direction of the moving sleeve body 31 and away from the moving sleeve body 31. The material core 20 is mounted in the moving sleeve body 31, the brush head 10 is rotatably connected between the two moving arms 32, both of the two moving arms 32 are provided with semicircular holes 321, and the two ends of the connecting shaft 14 penetrate the two semicircular holes 321 respectively. Specifically, the moving sleeve body 31 serves as a mounting base of the material core 20, and the moving arm 32 serves as a mounting base of the brush head 10. At the same time, a gap formed between the two moving arms 32 can provide a turnover space for the brush head 10 to turn over, so that the turnover of the brush head 10 is smoother and more reliable. Additionally, the two ends of the connecting shaft 14 are respectively connected by penetrating the semicircular holes 321 of the two moving arms 32, so that the reliability of the connection between the brush head 10 and the moving sleeve 30 is good, and the reliability and stability of the turnover of the brush head 10 are better. In order to improve the reliability and stability of the turnover of the brush head 10, the two moving arms 32 are both provided with rotation posts 322, the two opposite sides of the brush head 10 are both provided with rotation grooves 114, and the two rotation posts 322 are rotatably connected in the rotation grooves 114 respectively.

In another embodiment of the present disclosure, as shown in FIGS. 10 and 11, the spacing between the two moving arms 32 of the provided cosmetic tool is smaller than the outer diameter of the material core 20, the outer diameter of the material core 20 is smaller than the inner diameter of the moving sleeve body 31, so that it can ensure that the material core 20 is smoothly mounted in the moving sleeve body 31 by penetrating. At the same time, the spacing between the two moving arms 32 is smaller than the outer diameter of the material core 20, so the spacing between the opposite sides of the two moving arms 32 is also smaller than the inner diameter of the moving sleeve body 31. When the material core 20 is inserted into the moving sleeve body 31, the material core 20 abuts against the end face of the moving arm 32 near the moving sleeve body 31, thereby realizing the axial positioning of the material core 20.

Figure 12:
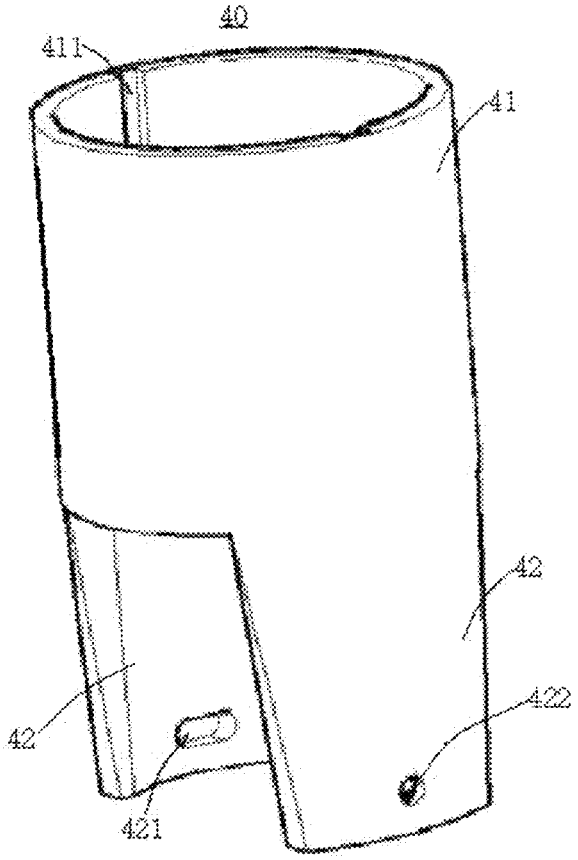
FIG. 12 is a schematic structural diagram of the fixed sleeve as shown in FIG. 9 from a third perspective.
Figure 13:
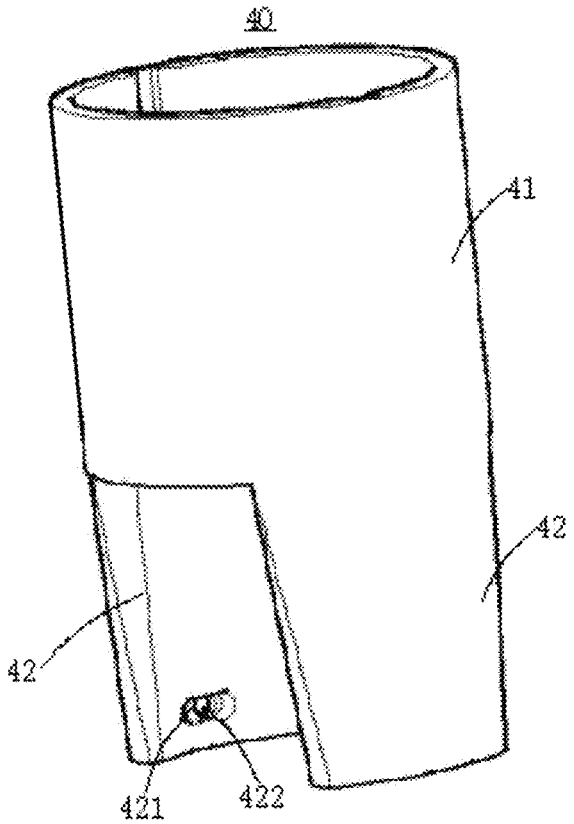
FIG. 13 is a schematic structural diagram of the fixed sleeve as shown in FIG. 9 from a fourth perspective.

In another embodiment of the present disclosure, as shown in FIGS. 12 and 13, the fixed sleeve 40 of the provided cosmetic tool includes a fixed sleeve body 41 and two fixed arms 42. The two fixed arms are respectively connected with two opposite sides of the fixed sleeve body 41 and extend along the axial direction of the fixed sleeve 40 and away from the fixed sleeve body 41. The fixed sleeve body 41 is sleeved outside the moving sleeve 30, the two fixed arms 42 are each provided with a limiting groove 421, and two ends of the connecting shaft 14 are respectively inserted into the two limiting grooves 421. Specifically, the fixed sleeve body 41 is sleeved outside the moving sleeve body 31, and the gap formed between the two fixed arms 42 can provide a turnover space for the brush head 10 to turn over, so that the turnover of the brush head 10 is smoother and more reliable. Additionally, the two ends of the connecting shaft 14 are respectively inserted into the two limiting grooves 421, so that the reliability of the connection between the brush head 10 and the fixed sleeve 40 is good, and the reliability and stability of the turnover of the brush head 10 are better.

In this embodiment, the length of the fixed sleeve body 41 is longer than that of the moving sleeve body 31, and the fixed sleeve body 41 can shield part of the moving arms 32, so that the appearance of the whole cosmetic tool is more beautiful.

In another embodiment of the present disclosure, as shown in FIG. 9, the cosmetic tool of the provided cosmetic tool further includes an elastic member 90 sleeved outside the moving sleeve 30, and two ends of the elastic member 90 are respectively connected with the moving sleeve 30 and the fixed sleeve 40. Specifically, when the moving sleeve 30 is pushed to move towards the brush head 10, the elastic member 90 is compressed. When the moving sleeve 30 is moved into position, that is, after the brush head 10 dips in the cosmetic substance, the elastic member 90 drives the moving sleeve 30 to move reversely under the action of its own restoring force, realizing the automatic reset of the moving sleeve 30, and drives the brush head 10 to move reversely and turn over reversely, realizing the automatic reset of the brush head 10. Thus, the use of the cosmetic tool is simple and convenient. The elastic member 90 is an elastic component, such as a spring.

In this embodiment, the end portion of the moving sleeve body 31 facing away from the moving arm 32 is provided with a flange 311, a stepped surface is disposed in the fixed sleeve body 41, and the two ends of the elastic member 90 respectively abut against the side surface of the flange 311 facing the moving arm 32 and the stepped surface, thereby realizing the fixation of the elastic member 90. The outer peripheral surface of the flange 311 is provided with a guide protrusion 312, the inner wall of the fixed sleeve body 41 is provided with a guide groove 411 extending along the axial direction, and the guide protrusion 312 is inserted into the guide groove 411, so that the guide protrusion 312 moves in the guide groove 411 in the process of pushing the moving sleeve 30 to move axially, thereby playing a guiding role in the operation of the moving sleeve 30, and improving the reliability and stability of the movement of the moving sleeve 30. Meanwhile, with the cooperation of the guide protrusion 312 and the guide groove 411, the circumferential positioning of the moving sleeve 30 can also be realized, so that the moving sleeve 30 cannot rotate in the circumferential direction, thereby preventing the connecting shaft 14, the semicircular hole 321 and the limiting groove 421 from being damaged.

In this embodiment, as shown in FIGS. 10 and 12, the number of the guide protrusions 312 may be two, three or more than four, the guide protrusions 312 are disposed at intervals along the circumferential direction of the moving sleeve body 31, the guide protrusions 312 are disposed in one-to-one correspondence with the guide grooves 411, and the number of the guide protrusions 312 is multiple, so that the axial movement of the moving sleeve 30 is more stable and reliable. Considering processing and structural strength, it is preferable that the number of the guide protrusions 312 is two, and the guide protrusions are located on opposite sides of the moving sleeve 30.

Figure 14:
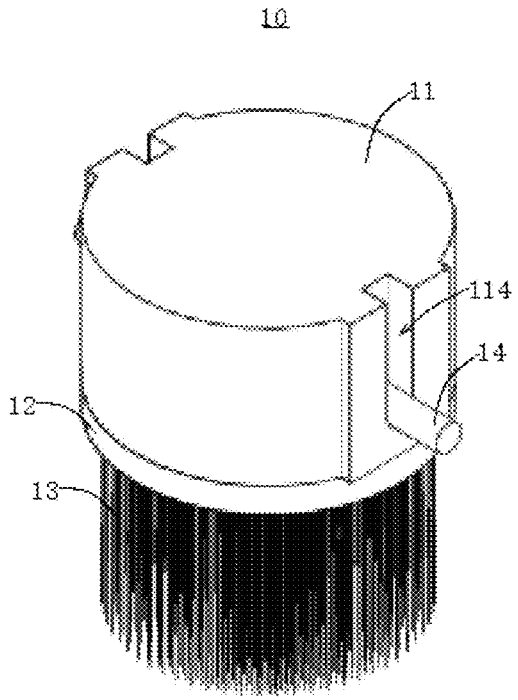
FIG. 14 is a schematic structural diagram of the brush head as shown in FIG. 9.
Figure 16:
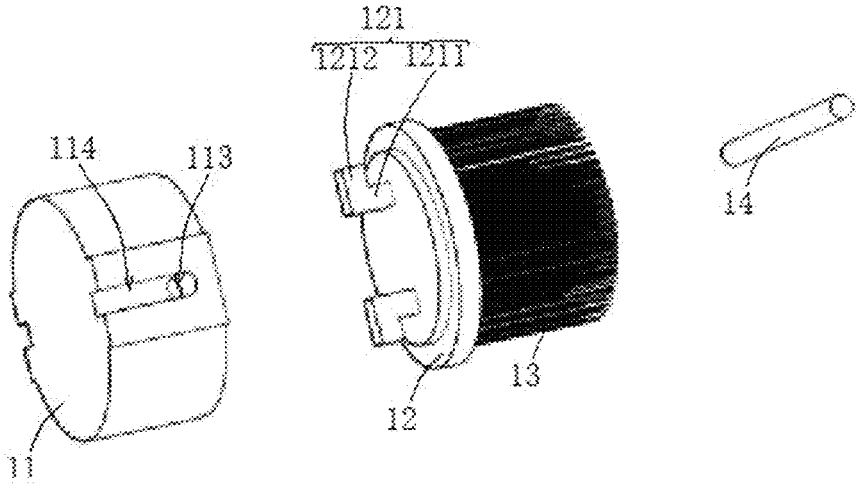
FIG. 16 is an exploded view of the brush head as shown in FIG. 14 from a sixth perspective.

In another embodiment of the present disclosure, as shown in FIGS. 14, 15 and 16, the brush head 10 of the provided cosmetic tool includes a brush head holder 11, a fixing member 12 and a dipping member 13 for dipping in the cosmetic substance and capable of brushing the cosmetic substances onto the skin. The dipping member 13 is mounted on the fixed member 12, a connecting shaft 14 is connected with the brush head holder 11, and the brush head holder 11 is rotatably connected with a moving sleeve 30. The fixing member 12 is provided with a buckle 121 thereon, and the brush head holder 11 is provided with a clamping groove 112 clamped with the buckle 121. The brush head holder 11 and the fixing member 12 are connected by the clamping of the buckle 121 and the clamping groove 112, so that the fixing member 12 can be detached from the brush head holder 11 to facilitate the replacement of the dipping member 13. Specifically, the brush head 10 can be replaced with different types of dipping members 13, thus meeting the brushing requirements of different cosmetic substances and different areas, and improving the universality, disclosure range and practicability of the cosmetic tool. The used dipping member 13 can also be replaced from the brush head 10 to facilitate the cleaning of the dipping member 13.

In this embodiment, the brush head holder 11 is cylindrical shaped, the end face of the brush head holder 11 is provided with an mounting cavity 111, the clamping groove 112 is disposed on the inner peripheral wall of the mounting cavity 111, the fixing member 12 is plate-shaped, the dipping member 13 and the buckle 121 are respectively located on the opposite surfaces of the fixing member 12, wherein the buckle 121 includes a horizontal section 1211 and a vertical section 1212, one end of the horizontal section 1211 is vertically connected with the fixing member 12 and the other end of the horizontal section 1211 is connected with the vertical section 1212; the clamping groove 112 includes an axial section 1122 and a circumferential section 1121, the axial section 1122 extends along the axis of the mounting cavity 111 and the circumferential section 1121 extends along the circumferential direction of the mounting cavity 111. Then when the dipping member 13 is mounted on the brush head holder 11, an end portion of the vertical section 1212 is first inserted into the axial section 1122 and moves along the axial direction. After the vertical section 1212 moves to an end portion of the axial section 1122, the fixing member 12 is rotated to clamp the vertical section 1212 into the circumferential section 1121, thereby realizing the fixing of the fixing member 12 relative to the brush head holder 11. When the dipping member 13 needs to be replaced, it only needs to rotate the fixing member 12 reversely, so that the end portion of the vertical section 1212 rotates to the connection of the circumferential section 1121 and the axial section 1122, and then the end portion of the vertical section 1212 is moved out along the axial section 1122.

In this embodiment, the number of the buckles 121 can be two, three or more than four, the buckles 121 are disposed at intervals along the circumferential direction of the fixing plate, the buckles 121 are disposed in one-to-one correspondence with the clamping grooves 112, and the number of the buckles 121 is multiple, so that the reliability of the connection between the fixing plate 12 and the brush head holder 11 is better. Considering processing and structural strength, it is preferable that the number of buckles 121 is two, and the buckles are located on the two opposite sides of the moving sleeve 30.

Of course, in other embodiments, the fixing member 12 may also be fixedly connected with the brush head holder 11. For example, the fixing member 12 and the brush head holder 11 are integrally molded by injection molding or 3D printing, or the fixing member 12 is connected with the brush head holder 11 by welding. In this way, the fixing member 12 and the brush head holder 11 are not detachable, and the dipping member 13 is not replaceable.

In this embodiment, the peripheral wall of the brush head holder 11 is provided with two rotation grooves 114, the bottom surfaces of the two rotation grooves 114 are each provided with a first penetrating hole 113, and the bottom surface of one of the limiting grooves 421 is provided with a second penetrating hole 422, so that the connecting shaft 14 located outside the fixed sleeve 40 passes through the second penetrating hole 422, is then inserted into the semicircular hole 321, penetrates the brush head holder 11 through the two first penetrating holes 113, and then penetrates into the semicircular hole 321 and the limiting groove 421 on the other side, and then a plug is plugged into the second penetrating hole 422 to prevent the connecting shaft 14 from moving out of the second penetrating hole 422, thereby realizing the fixed installation of the connecting shaft 14.

In another embodiment of the present disclosure, the fixing member 12 of the provided cosmetic tool is provided with a clamping groove 112, and the brush head holder 11 is provided with a buckle 121 clamped with the clamping groove 112. The buckle 121 and the clamping groove 112 can refer to the structures of the aforementioned embodiments, or can be different from the structures of the aforementioned embodiments, and the specific structure can be selected according to the actual situation, so long as the fixing member 12 and the brush head holder 11 can be connected in a clamping manner.

In another embodiment of the present disclosure, the material core 20 of the provided cosmetic tool is detachably connected with the moving sleeve 30, thereby facilitating the replacement of the material core 20.

In this embodiment, as shown in FIGS. 7, 8 and 9, the cosmetic tool further comprises a material core cover 60, which is screwed to the end portion of the moving sleeve body 31 facing away from the moving arm 32, thereby preventing the material core 20 from moving out of the moving sleeve body 31. Additionally, the end face of the material core 20 facing away from the discharge port is provided with a handle 21, which is exposed outside the moving sleeve body 31 and abuts against the material core cover 60, while the other end of the material core 20 abuts against the end face of the moving arm 32, thereby realizing the axial fixation of the material core 20. The fixation structure is simple and convenient to manufacture. Additionally, the handle 21 is exposed outside the moving sleeve body 31, so that the material core 20 can be directly pulled out of the moving sleeve body 31 for replacement of the material core 20, thereby realizing movable replacement of the material core 20. The structural design is ingenious, so that the use of the cosmetic tool has better convenience. The material core covers 60 is also sleeved with an outer cover 70, which is an aluminum alloy outer cover 70, a plastic outer cover 70, an iron outer cover 70 or an outer cover 70 made of other materials, so as to enhance the aesthetics of the appearance of the cosmetic tool.

In another embodiment of the present disclosure, the material core 20 of the provided cosmetic tool is fixedly connected with the moving sleeve body 31, for example: The material core 20 and the moving sleeve body 31 may also be integrally molded by injection molding or 3D printing, or the material core can be connected with the moving sleeve body 31 by welding. In this way, the material core 20 and the moving sleeve 31 are not detachable, and the material core is not replaceable.

In this embodiment, the cosmetic tool further includes a brush head cover 80, which covers the brush head 10 and is connected with the fixed sleeve 40 in a clamping manner. The brush head cover 80 enables the brush head 10 to be not exposed and in an enclosed environment, so that the cleanliness of the brush head 10 is better and the use safety is better.

The above is only the preferred embodiments of the present disclosure, and it is not used for limiting the present disclosure. Any modification, equivalent substitution and improvement made within the spirit and principle of the present disclosure should be included in the claimed scope of the present disclosure.

What is claimed is:

1. A cosmetic tool, comprising:

a brush head;

a material core loaded with a cosmetic substance;

a moving sleeve, wherein the material core is mounted in the moving sleeve, the brush head is located at one end of the moving sleeve and disposed opposite to the material core, and an end face of the material core facing the brush head is provided with a discharge port;

a fixed sleeve, wherein the fixed sleeve is sleeved outside the moving sleeve, and the moving sleeve is movable along an axial direction; and a transmission structure through which the fixed sleeve, the moving sleeve and the brush head are connected;

wherein when the moving sleeve moves along the axial direction, the moving sleeve drives the brush head to turn over through the transmission structure, so as to dip in the cosmetic substance at the discharge port.

2. The cosmetic tool according to claim 1, wherein the transmission structure comprises a transmission mechanism through which the fixed sleeve, the moving sleeve and the brush head are connected;

wherein when the moving sleeve moves along the axial direction, the moving sleeve drives the brush head to turn over through the transmission mechanism, so as to dip in the cosmetic substance at the discharge port.

3. The cosmetic tool according to claim 2, wherein the transmission mechanism comprises a rack and an engaging gear for engaging with and mating with the rack, the rack is disposed on an inner wall of the fixed sleeve and extends along an axial direction of the moving sleeve, and the engaging gear is mounted on an outer wall of the moving sleeve and connected with the brush head;

wherein when the moving sleeve moves along the axial direction, the rack drives the engaging gear to rotate, and the engaging gear drives the brush head to turn over.

4. The cosmetic tool according to claim 3, wherein the transmission mechanism comprises multiple transmission gears, the engaging gear and the multiple transmission gears are sequentially engaged along a direction of the material core towards the brush head and along the axial direction of the moving sleeve, and outer diameters of the transmission gears are each smaller than that of the engaging gear, and one of the transmission gears is connected with the brush head.

5. The cosmetic tool according to claim 4, wherein the brush head comprises a brush head holder and a dipping member for dipping in the cosmetic substance, an outer peripheral wall of the brush head holder is provided with a connecting post, an inner wall of the moving sleeve is provided with a connecting hole, and the connecting post penetrates through the connecting hole and is then connected with the transmission gear.

6. The cosmetic tool according to claim 5, wherein the brush head further comprises a first elastic member and a connecting shaft, the brush head holder has an opening-shaped mounting cavity, the dipping member is mounted as covering the opening-shaped mounting cavity, the brush head holder is provided with a rotating hole communicated with the mounting cavity, the rotating hole is disposed opposite to the connecting post, the connecting shaft is inserted into the mounting cavity from the rotating hole, and one end of the connecting shaft facing the rotating hole is fixedly connected with the moving sleeve;

wherein the first elastic member is sleeved on the connecting shaft, one end of the connecting shaft facing away from the rotating hole is connected with one end of the first elastic member, another end of the first elastic member is connected with the brush head holder, and the first elastic member is used for driving the brush head holder to turn over reversely, so that the dipping member is disposed as facing away from the material core.

7. The cosmetic tool according to claim 6, wherein the dipping member is detachably connected with the brush head holder; or alternatively, the dipping member is fixedly connected with the brush head holder.

8. The cosmetic tool according to claim 5, wherein the outer peripheral wall of the brush head holder is provided with a semicircular groove centered on a rotation axis around which the brush head holder rotates, the inner wall of the moving sleeve is provided with a limiting post that is inserted into the semicircular groove and movable in the semicircular groove along with the rotation of the brush head holder to limit an overturning angle of the brush head holder;

or alternatively, the inner wall of the moving sleeve is provided with a semicircular groove centered on a rotation axis around which the brush head holder rotates, the outer peripheral wall of the brush head holder is provided with a limiting post that is inserted into the semicircular groove and movable in the semicircular groove along with the rotation of the brush head holder to limit the overturning angle of the brush head holder.

9. The cosmetic tool according to claim 1, wherein an inner wall of the fixed sleeve is provided with a guide groove extending along the axial direction, an outer peripheral wall of the moving sleeve is provided with a guide protrusion inserted into the guide groove;

or alternatively, the inner wall of the fixed sleeve is provided with a guide protrusion, and outer peripheral wall of the moving sleeve is provided with a guide groove extending along the axial direction.

10. The cosmetic tool according to claim 9, wherein the cosmetic tool further comprises a second elastic member located in the guide groove, one end of the second elastic member is connected with the fixed sleeve, another end of the second elastic member is connected with the guide protrusion, and the second elastic member is used for driving the moving sleeve to move away from the brush head.

11. The cosmetic tool according to claim 1, wherein the brush head is rotatably connected with the moving sleeve, the brush head is provided with a connecting shaft, and a rotating structure of the cosmetic tool comprises a semicircular hole and a limiting groove;

the semicircular hole is disposed on an inner wall of the moving sleeve and centered on a rotation axis of the brush head, a connecting line between two ends of the semicircular hole is parallel to the axial direction of the moving sleeve, the limiting groove is disposed on the inner wall of the fixed sleeve and perpendicular to the axial direction of the moving sleeve, and an end portion of the connecting shaft is disposed as passing through the semicircular hole and the limiting groove.

12. The cosmetic tool according to claim 11, wherein the inner wall of the moving sleeve is provided with a rotation post, a peripheral wall of the brush head is provided with a rotation groove, and the rotation post is rotatably connected in the rotation groove;

or alternatively, the inner wall of the moving sleeve is provided with a rotation groove, and a peripheral wall of the brush head is provided with a rotation post that is rotatably connected in the rotation groove.

13. The cosmetic tool according to claim 12, wherein the rotation groove is an elongated groove parallel to the axial direction of the moving sleeve;

the inner wall of the moving sleeve is further provided with a linear hole that is communicated with the end portion of the semicircular hole and extends along the axial direction of the moving sleeve and away from the semicircular hole.

14. The cosmetic tool according to claim 13, wherein both ends of the semicircular hole are communicated with the linear hole.

15. The cosmetic tool according to claim 11, wherein the moving sleeve comprises a moving sleeve body and two moving arms, and the two moving arms are respectively connected with two opposite sides of the moving sleeve body and extend along the axial direction of the moving sleeve body and away from the moving sleeve body; the material core is mounted in the moving sleeve body, the brush head is rotatably connected between the two moving arms, each of the two moving arms is provided with the semicircular hole, and both ends of the connecting shaft are disposed as respectively passing through the two semicircular holes.

16. The cosmetic tool according to claim 15, wherein a distance between the two moving arms is smaller than an outer diameter of the material core, and the outer diameter of the material core is smaller than an inner diameter of the moving sleeve.

17. The cosmetic tool according to claim 11, wherein the fixed sleeve comprises a fixed sleeve body and two fixed arms, and the two fixed arms are respectively connected with two opposite sides of the fixed sleeve body and extend along the axial direction of the fixed sleeve and away from the fixed sleeve body; the fixed sleeve body is sleeved outside the moving sleeve, each of the two fixed arms is provided with the limiting groove, and both ends of the connecting shaft are respectively inserted into the two limiting grooves.

18. The cosmetic tool according to claim 11, wherein the cosmetic tool further comprises an elastic member sleeved outside the moving sleeve, and both ends of the elastic member are respectively connected with the moving sleeve and the fixed sleeve.

19. The cosmetic tool according to claim 11, wherein the brush head comprises a brush head holder, a fixing member and a dipping member for dipping in the cosmetic substance and capable of brushing the cosmetic substance onto skin, the dipping member is mounted on the fixing member, the connecting shaft is connected with the brush head holder, and the brush head holder is rotatably connected with the moving sleeve;

a buckle is disposed on the fixing member, and a clamping groove into which the buckle is snapped is disposed on the brush head holder;

or alternatively, a clamping groove is disposed on the fixing member, and a buckle snapped into the clamping groove is disposed on the brush head holder.

20. The cosmetic tool according to claim 1, wherein the material core and the moving sleeve are detachably connected; or alternatively, the material core and the moving sleeve are fixedly connected.

* * * * *